US009999311B1

(12) United States Patent
Penso

(10) Patent No.: US 9,999,311 B1
(45) Date of Patent: Jun. 19, 2018

(54) ZIPPER PULLER DEVICE

(71) Applicant: Christine Penso, Ft. Lauderdale, FL (US)

(72) Inventor: Christine Penso, Ft. Lauderdale, FL (US)

( * ) Notice: Subject to any disclaimer, the term of this patent is extended or adjusted under 35 U.S.C. 154(b) by 0 days. days.

(21) Appl. No.: 15/798,544

(22) Filed: Oct. 31, 2017

(51) Int. Cl.
*B25J 1/02* (2006.01)
*A47G 25/90* (2006.01)

(52) U.S. Cl.
CPC ..... *A47G 25/902* (2013.01)

(58) Field of Classification Search
CPC ..... A47G 25/902
USPC ..... 294/3.6, 24, 25, 26, 57, 58, 59, 210; 16/422, 426, 430
See application file for complete search history.

(56) References Cited

U.S. PATENT DOCUMENTS 30,933 A * 5/1899 Crees
2,882,577 A * 4/1959 Johnson ..... A47G 25/902 294/3.6
2,928,157 A 3/1960 Deering
3,276,087 A * 10/1966 Hanson ..... A47G 25/902 294/104
3,310,853 A 3/1967 Winn
D207,628 S 5/1967 Zern
4,785,495 A * 11/1988 Dellis ..... B25G 1/102 16/421
4,890,355 A * 1/1990 Schulten ..... A45F 5/1046 16/421
5,487,576 A * 1/1996 DuVivier ..... B25B 9/00 294/210
5,558,377 A * 9/1996 Blum ..... B25J 1/00 294/210
5,975,386 A 11/1999 Fernicola
6,003,915 A * 12/1999 Bierman ..... E01H 5/02 280/823
6,032,996 A 3/2000 Kogen
D435,328 S * 12/2000 Harris ..... D11/221
6,494,512 B1 12/2002 Cada
6,499,778 B2 * 12/2002 Boulay ..... B25B 9/00 254/134.3 R
8,210,584 B2 * 7/2012 Hiltz ..... B62D 53/0857 294/175
D679,560 S * 4/2013 Fehsenfeld ..... D8/14
9,750,363 B2 * 9/2017 Burton ..... A47G 25/902
2013/0234458 A1 9/2013 Wilkins

* cited by examiner

*Primary Examiner* — Paul T Chin

(57) ABSTRACT

The zipper puller device is configured for use with the pull tab of a zipper. The pull tab is further defined with a recovery aperture. The zipper puller device is an extension structure. Specifically, the zipper puller device extends the reach of an individual such that a hard to reach zipper may be secured by the individual without assistance. The span of the extension provided by the zipper puller device is adjustable. The zipper puller device comprises an ergonomic handle, a telescopic shaft, and a hook. The telescopic shaft attaches the hook to the ergonomic handle. The hook attaches to the recovery aperture. The handle manipulates the hook when the zipper puller device is in use. The span of the length of the telescopic shaft is adjustable.

7 Claims, 5 Drawing Sheets

COTTER PIN

SPRING LOADED BALL LOCK

G SNAP COLLAR

SPLIT COLLAR LOCK

THREADED CLUTCH

INTERNAL CAM LOCK

ZIPPER PULLER DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles including household implements used with wearing apparel, more specifically, a device for opening and closing slide fasteners on apparel.

SUMMARY OF INVENTION

The zipper puller device is configured for use with a zipper. The zipper further comprises a pull tab. The pull tab is further defined with a recovery aperture. The recovery aperture is an aperture located within the pull tab of the zipper. Although other purposes for the recovery aperture are known, the intended purpose of the recovery aperture is to provide an anchor point that allows the zipper to be secured to a button or a safety pin during a wardrobe malfunction. The zipper puller device is an extension structure. Specifically, the zipper puller device extends the reach of an individual such that a hard to reach zipper may be secured by an individual without assistance. The span of the extension provided by the zipper puller device is adjustable. The zipper puller device comprises an ergonomic handle, a telescopic shaft, and a hook. The telescopic shaft attaches the hook to the ergonomic handle. The hook attaches to the recovery aperture. The handle manipulates the hook when the zipper puller device is in use. The span of the length of the telescopic shaft is adjustable.

These together with additional objects, features and advantages of the zipper puller device will be readily apparent to those of ordinary skill in the art upon reading the following detailed description of the presently preferred, but nonetheless illustrative, embodiments when taken in conjunction with the accompanying drawings.

In this respect, before explaining the current embodiments of the zipper puller device in detail, it is to be understood that the zipper puller device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the zipper puller device.

It is therefore important that the claims be regarded as including such equivalent construction insofar as they do not depart from the spirit and scope of the zipper puller device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
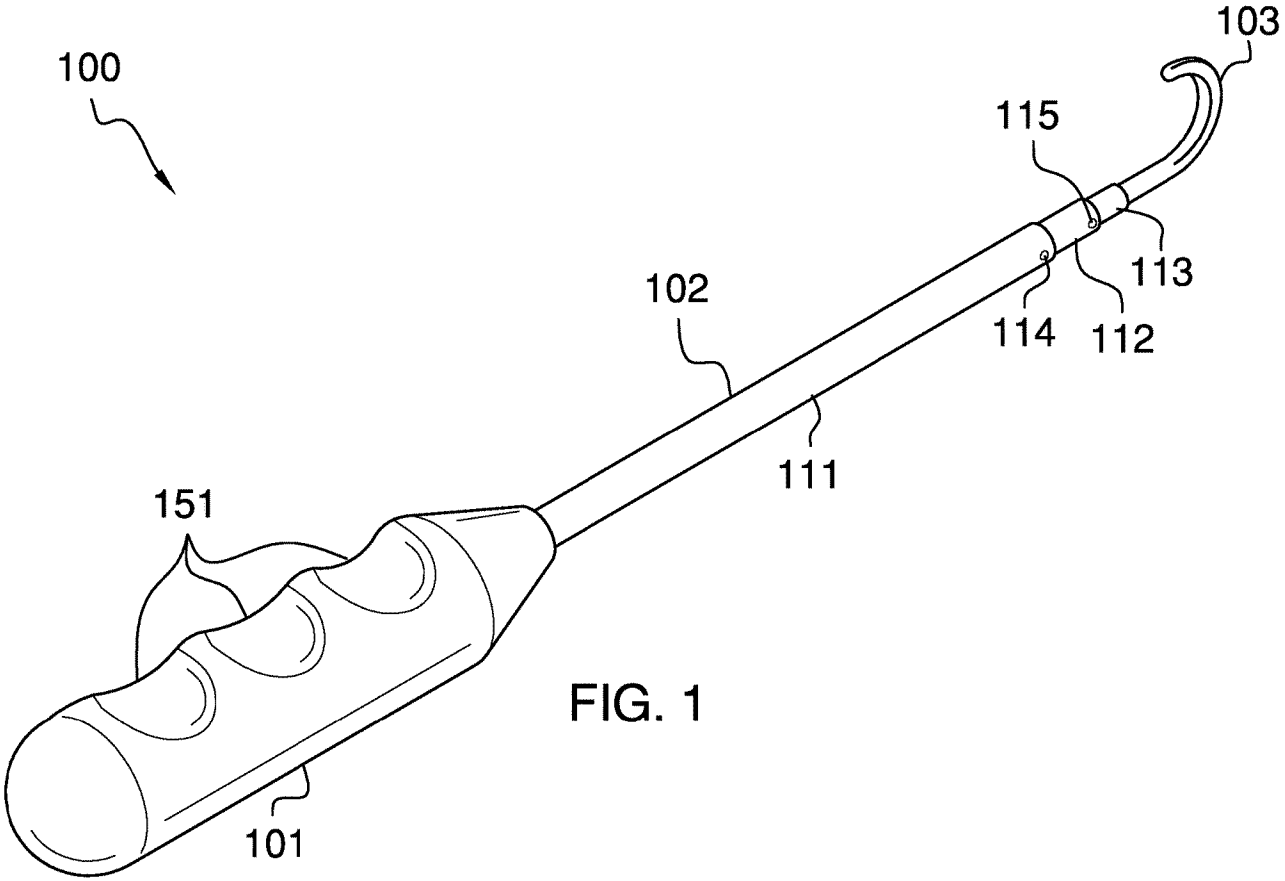
FIG. 1 is a perspective view of an embodiment of the disclosure.
Figure 2:
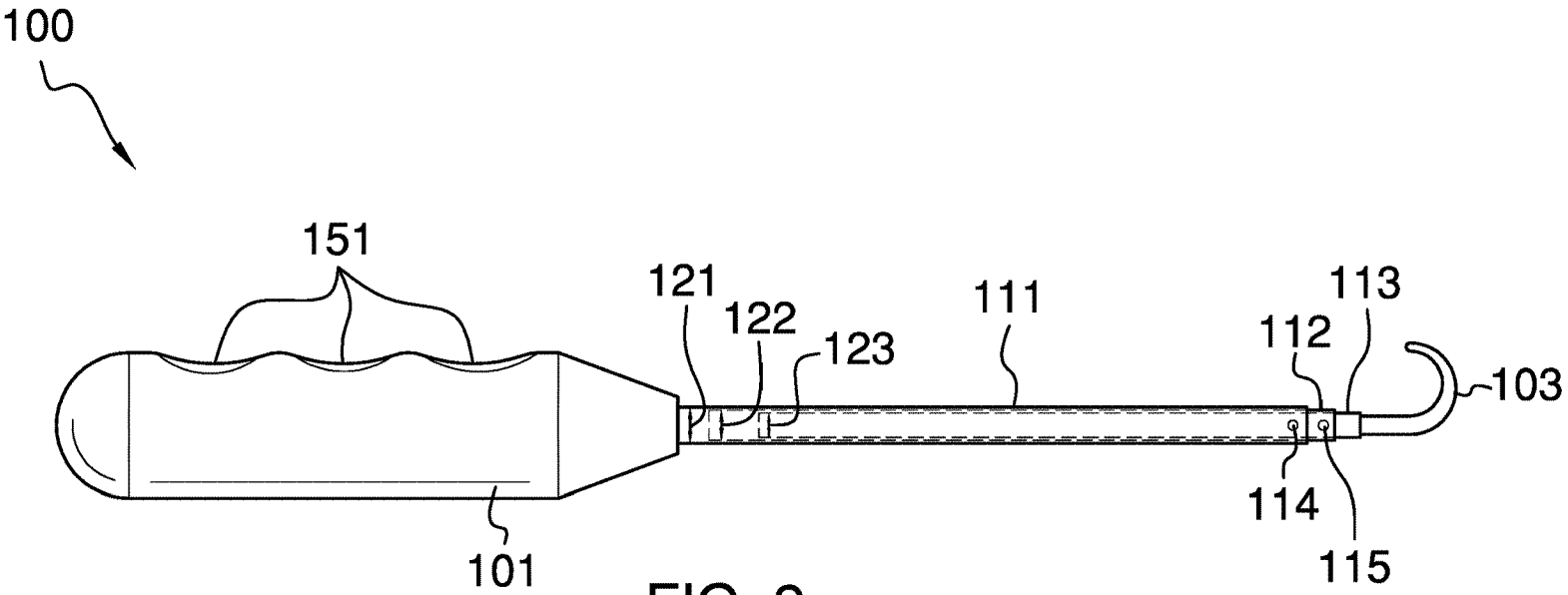
FIG. 2 is a front view of an embodiment of the disclosure.
Figure 3:
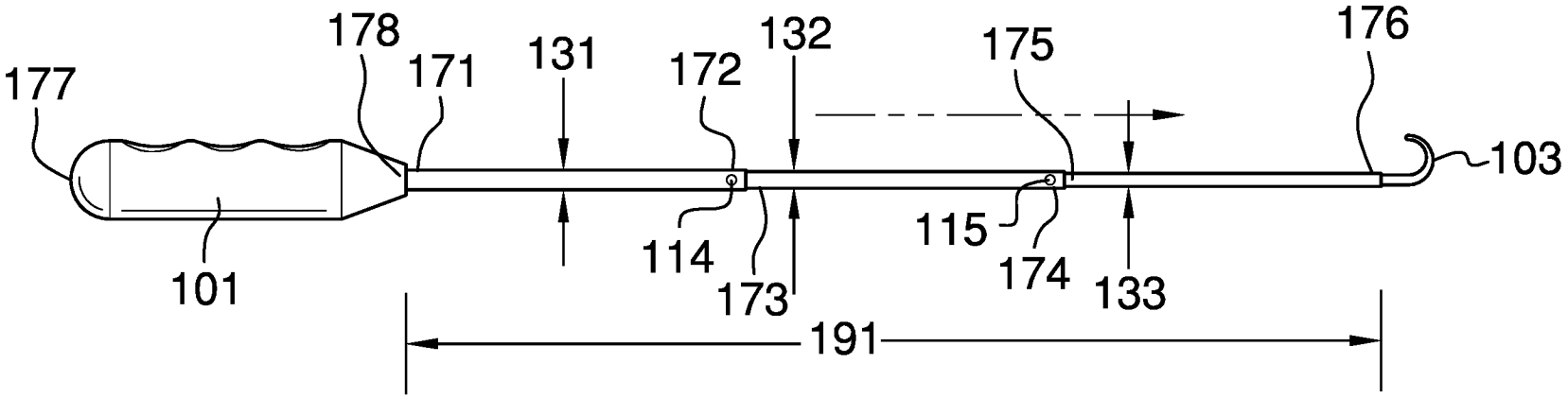
FIG. 3 is a detail view of an embodiment of the disclosure.
Figure 4:
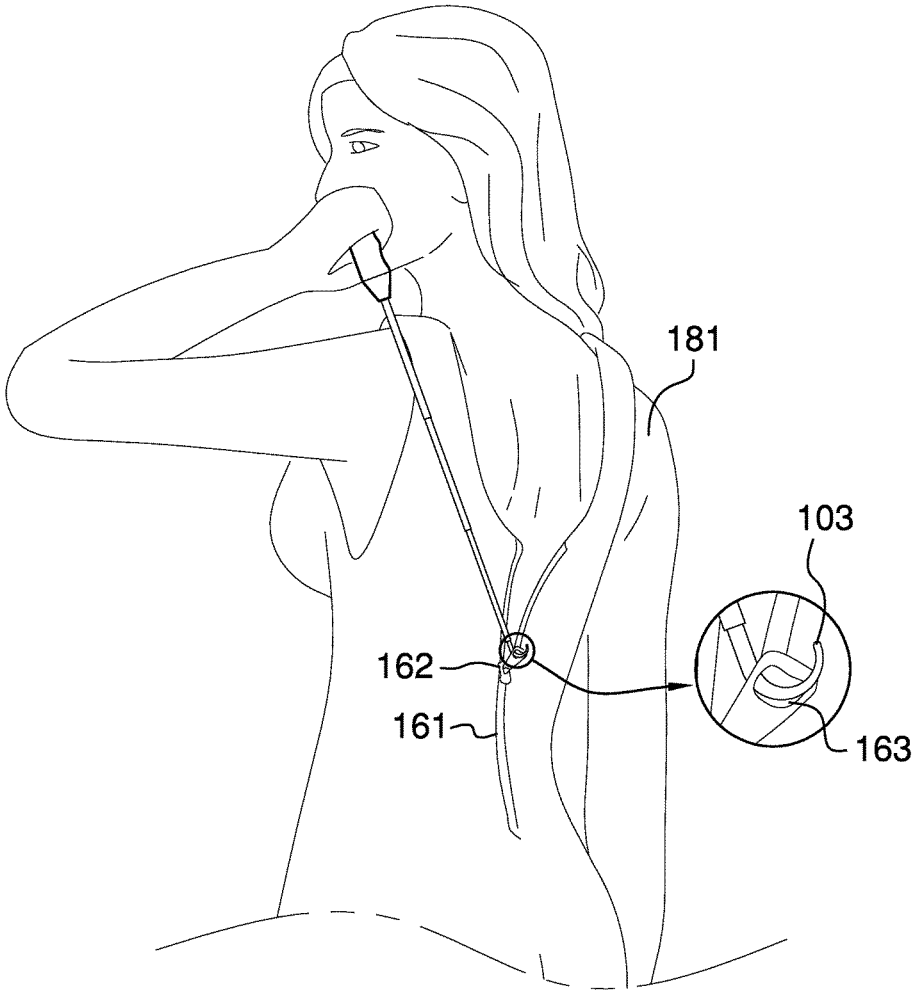
FIG. 4 is an in use view of an embodiment of the disclosure.
Figure 5:
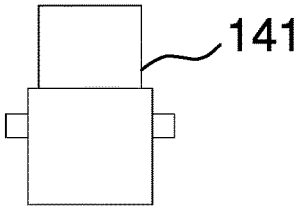
FIG. 5 is a detail view of an embodiment of the disclosure.
Figure 10:
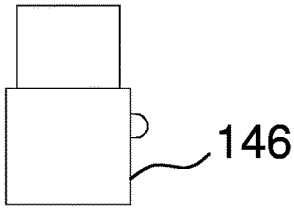
FIG. 10 is a detail view of an embodiment of the disclosure.
Figure 6:
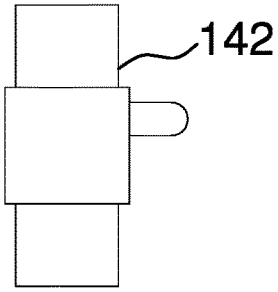
FIG. 6 is a detail view of an embodiment of the disclosure.
Figure 9:
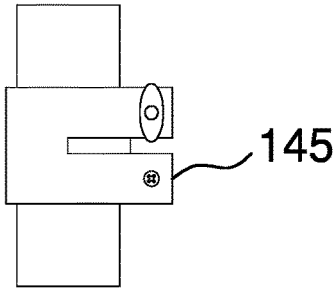
FIG. 9 is a detail view of an embodiment of the disclosure.
Figure 8:
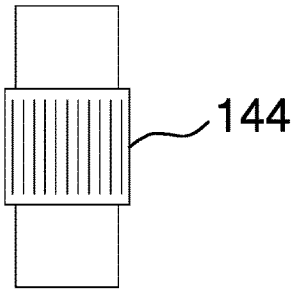
FIG. 8 is a detail view of an embodiment of the disclosure.
Figure 7:
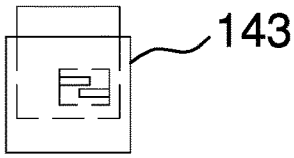
FIG. 7 is a detail view of an embodiment of the disclosure.

Detailed reference will now be made to one or more potential embodiments of the disclosure, which are illustrated in FIGS. 1 through 10.

The zipper puller device 100 (hereinafter invention) is configured for use with a zipper 161. The zipper 161 further comprises a pull tab 162. The pull tab 162 is further defined with a recovery aperture 163. The recovery aperture 163 is an aperture located within the pull tab 162 of the zipper 161. Although other purposes for the recovery aperture 163 are known, the intended purpose of the recovery aperture 163 is to provide an anchor point that allows the zipper 161 to be secured to a button or a safety pin during a wardrobe malfunction. The invention 100 is an extension structure. Specifically, the invention 100 extends the reach of an individual 181 such that a hard to reach zipper 161 may be secured by the individual 181 without assistance. The extension provided by the invention 100 is adjustable. The invention 100 comprises an ergonomic handle 101, a telescopic shaft 102, and a hook 103. The telescopic shaft 102 attaches the hook 103 to the ergonomic handle 101. The hook 103 attaches to the recovery aperture 163. The ergonomic handle 101 manipulates the hook 103 when the invention 100 is in use. The span of the length 191 of the telescopic shaft 102 is adjustable.

The zipper 161 is a fastener that is commonly used to secure a garment to an individual 181. The zipper 161 is discussed in greater detail elsewhere in this disclosure. The zipper 161 is well-known and documented in the textile and apparel arts. The pull tab 162 is a structure that is grasped by the individual 181 to open and close the zipper 161. The pull tab 162 is a well-known and documented structure that is commonly associated with a zipper 161.

The ergonomic handle 101 is a prism structure that forms the handle of the invention 100. The ergonomic handle 101 is grasped by the individual 181 in order to reach and use the pull tab 162 of the zipper 161. The ergonomic handle 101 further comprises a grip 151. The ergonomic handle 101 is further defined with a seventh end 177 and an eighth end 178. The seventh end 177 is the end of the ergonomic handle 101 that is distal from the hook 103. The eighth end 178 is the end of the ergonomic handle 101 that is distal from the seventh end 177.

The grip 151 is an ergonomic structure that is formed in the ergonomic handle 101. The grip 151 comprises a plurality of grooves that are sized to receive the fingers of the individual 181. The grip 151 prevents the ergonomic handle 101 from slipping during use of the invention 100.

The telescopic shaft 102 forms the extension structure of the invention 100. The telescopic shaft 102 is a telescopic structure. The span of the length 191 of the telescopic structure is adjustable. The telescopic shaft 102 is further defined with a span of a length 191.

The telescopic shaft 102 comprises a first arm 111, a second arm 112, a third arm 113, a first detent 114, and a second detent 115. The first arm 111 is further defined with a first inner dimension 121, a first outer dimension 131, a first end 171, and a second end 172. The second arm 112 is further defined with a second inner dimension 122, a second outer dimension 132, a third end 173, and a fourth end 174. The third arm 113 is further defined with a third inner dimension 123, a third outer dimension 133, a fifth end 175, and a sixth end 176. The span of the length 191 is measured from the first end 171 of the first arm 111 to the sixth end 176 of the third arm 113.

The first arm 111 is a hollow first prism. The second arm 112 is a hollow second prism. The first arm 111 and the second arm 112 are geometrically similar. The second outer dimension of the second arm 112 is less than the first inner dimension 121 of the first arm 111 such that the second arm 112 can be inserted into the first arm 111 in a telescopic manner. This telescopic arrangement of the telescopic shaft 102 allows the span of the length 191 of the telescopic shaft 102 to be adjusted by adjusting the relative position of the second arm 112 within the first arm 111. The position of the second arm 112 relative to the first arm 111 is held in position using the first detent 114. The first detent 114 is a mechanical device that connects and secures the first arm 111 to the second arm 112. As shown most clearly in FIGS. 5 to 10, the first detent 114 is selected from the group consisting of a cotter pin 141, a G snap collar 142, a cam lock collar 143, a threaded clutch 144, a split collar lock 145, or a spring loaded ball lock 146.

The third arm 113 is a third prism. The second arm 112 and the third arm 113 are geometrically similar. The third outer dimension 133 of the third arm 113 is less than the second inner dimension 122 of the second arm 112 such that the third arm 113 can be inserted into the second arm 112 in a telescopic manner. This telescopic arrangement of the telescopic shaft 102 allows the span of the length 191 of the telescopic shaft 102 to be adjusted by adjusting the relative position of the third arm 113 within the second arm 112. The position of the third arm 113 relative to the second arm 112 is held in position using the second detent 115. The second detent 115 is a mechanical device that connects and secures the second arm 112 to the third arm 113. As shown most clearly in FIGS. 5 to 10, the second detent 115 is selected from the group consisting of a cotter pin 141, a G snap collar 142, a cam lock collar 143, a threaded clutch 144, a split collar lock 145, or a spring loaded ball lock 146.

In the first potential embodiment of the disclosure, the first end 171 of the first arm 111 attaches to the eighth end of the ergonomic handle 101. The third end 173 of the second arm 112 inserts into the second end 172 of the first arm 111. The fifth end 175 of the third arm 113 inserts into the fourth end 174 of the second arm 112. The first detent 114 is a spring loaded ball lock. The second detent 115 is a spring loaded ball lock.

The hook 103 is a curved structure that attaches the invention 100 to the zipper 161. The hook 103 inserts through the recovery aperture 163 of the pull tab 162. The hook 103 attaches to the sixth end 176 of the third arm 113.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Correspond: As used in this disclosure, the term correspond means that a first object is in some manner linked to a second object in a one to one relationship.

Detent: As used in this disclosure, a detent is a device for positioning and holding a first object relative to a second object such that the position of the first object relative to the second object is adjustable.

Extension Structure: As used in this disclosure, an extension structure is a physical structure that is used to extend the span of the distance between any two objects.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hook: As used in this disclosure, a hook is an object that is curved or bent at an angle such that items can be hung on or caught by the object.

Inner Diameter: As used in this disclosure, the term inner diameter is used in the same way that a plumber would refer to the inner diameter of a pipe.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Outer Diameter: As used in this disclosure, the term outer diameter is used in the same way that a plumber would refer to the outer diameter of a pipe.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Slot: As used in this disclosure, a slot is a groove that is formed in an object.

Telescopic: As used in this disclosure, telescopic is an adjective that describes an object made of sections that fit or slide into each other such that the object can be made longer or shorter by adjusting the relative positions of the sections.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A domestic article comprising:

an ergonomic handle, a telescopic shaft, and a hook;

wherein the telescopic shaft attaches the hook to the ergonomic handle;

wherein the domestic article is configured for use with an individual;

wherein the domestic article is configured for use with a zipper;

wherein the zipper further comprises a pull tab;

wherein the pull tab is further defined with a recovery aperture;

wherein the domestic article is an extension structure;

wherein the extension provided by the domestic article is adjustable;

wherein the domestic article attaches to the zipper;

wherein the telescopic shaft comprises a first arm, a second arm, and a third arm;

wherein the second arm attaches the first arm to the third arm;

wherein the first arm is further defined with a first inner dimension, a first outer dimension, a first end, and a second end;

wherein the second arm is further defined with a second inner dimension, a second outer dimension, a third end, and a fourth end;

wherein the third arm is further defined with a third inner dimension, a third outer dimension, a fifth end, and a sixth end;

wherein the span of the length is measured from the first end of the first arm to the sixth end of the third arm;

wherein the ergonomic handle is a prism structure;

wherein the ergonomic handle forms the handle of the domestic article;

wherein the ergonomic handle is grasped by the individual to reach and use the pull tab of the zipper;

wherein the ergonomic handle is further defined with a seventh end and an eighth end;

wherein the ergonomic handle further comprises a grip;

wherein the grip comprises a plurality of grooves that are sized to receive the fingers of the individual;

wherein the telescopic shaft forms the extension structure of the domestic article;

wherein the telescopic shaft is a telescopic structure;

wherein the span of the length of the telescopic structure is adjustable;

wherein the telescopic shaft is further defined with a span of a length;

wherein the telescopic shaft further comprises a first detent and a second detent;

wherein the first detent attaches the second arm relative to the first arm;

wherein the second detent attaches the third arm relative to the second arm;

wherein the first arm is a hollow first prism;

wherein the second arm is a hollow second prism;

wherein the third arm is a third prism;

wherein the first arm and the second arm are geometrically similar;

wherein the second arm and the third arm are geometrically similar;

wherein the second outer dimension of the second arm is less than the first inner dimension of the first arm such that the second arm inserts into the first arm;

wherein the span of the length of the telescopic shaft to be adjusted by adjusting the relative position of the second arm within the first arm.

2. The domestic article according to claim 1 wherein the third outer dimension of the third arm is less than the second inner dimension of the second arm such that the third arm inserts into the second arm;

wherein the span of the length of the telescopic shaft to be adjusted by adjusting the relative position of the third arm within the second arm.

3. The domestic article according to claim 2 wherein the first detent is a mechanical device;

wherein the position of the second arm relative to the first arm is held in position using the first detent.

4. The domestic article according to claim 3 wherein the second detent is a mechanical device;

wherein the position of the third arm relative to the second arm is held in position using the second detent.

5. The domestic article according to claim 4 wherein the first detent is a spring loaded ball lock;

wherein the second detent is a spring loaded ball lock.

6. The domestic article according to claim 5 wherein the hook is a curved structure;

wherein the hook attaches the domestic article to the zipper;

wherein the hook inserts through the recovery aperture of the pull tab;

wherein the hook attaches to the sixth end of the third arm.

7. The domestic article according to claim 6 wherein the first end of the first arm attaches to the eighth end of the ergonomic handle;

wherein the third end of the second arm inserts into the second end of the first arm;

wherein the fifth end of the third arm inserts into the fourth end of the second arm.

* * * * *